United States Patent [19]

Kudoh et al.

[11] Patent Number: 4,756,362

[45] Date of Patent: Jul. 12, 1988

[54] HEAT EXCHANGER

[75] Inventors: Mituo Kudoh, Tsuchiura; Takuji Torii, Ushiku; Seigo Miyamoto, Katsuta; Yoshitomo Sawahata, Hitachi; Mizuho Yokoyama, Katsuta; Masaru Takenouchi, Tsuchiura; Yoshifumi Kunugi, Ibaraki, all of Japan

[73] Assignee: Hitachi, Ltd., Tokyo, Japan

[21] Appl. No.: 895,847

[22] Filed: Aug. 12, 1986

[30] Foreign Application Priority Data

Sep. 6, 1985 [JP] Japan ..... 60-195870

[51] Int. Cl.[4] ..... F28D 1/04

[52] U.S. Cl. ..... 165/151; 165/152

[58] Field of Search ..... 165/151, 152

[56] References Cited

U.S. PATENT DOCUMENTS

| | | | |
|---|---|---|---|
| 2,789,797 | 4/1957 | Simpelaar | 165/151 |
| 4,469,167 | 9/1984 | Itoh et al. | 165/152 X |

FOREIGN PATENT DOCUMENTS

| | | | |
|---|---|---|---|
| 1212901 | 6/1958 | France | 165/151 |
| 37696 | 3/1982 | Japan | 165/151 |
| 144892 | 9/1982 | Japan | 165/151 |
| 20094 | 2/1985 | Japan | 165/151 |

*Primary Examiner*—Ira S. Lazarus
*Assistant Examiner*—Peggy Neils
*Attorney, Agent, or Firm*—Antonelli, Terry & Wands

[57] ABSTRACT

A heat exchanger comprising fins and at least one heat transfer tube. An even number, not smaller than four, of louvers are severed and raised in an alternate and staggered manner with respect to a fin base line between the remaining adjacent fin base. Furthermore, the louvers raised on the same side with respect to the fin base line have heights defined by a line slanted at a constant angle in a stepped manner.

5 Claims, 6 Drawing Sheets

HEAT EXCHANGER

BACKGROUND OF THE INVENTION

1. Field of the Invention

The present invention relates to a heat exchanger for use in air-conditioners such as automotive air-conditioners, package air-conditioners and room air-conditioners.

2. Description of the Prior Art

In general, a heat exchanger for an air-conditioner is composed, in combination, of a number of fins and a plurality of heat transfer tubes held in contact with the fins. A severed, raised louver structure is formed on a surface of each fin in order to effectively carry out heat exchange between coolant that flows within the heat transfer tubes and air that flows between the fins in contact with the fin surfaces. U.S. Pat. No. 3,438,433 shows a heat exchanger of this type. However, if the louvers are arranged as proposed in that U.S. patent, a temperature boundary layer formed on the louvers would grow without any separation, so that a heat transfer performance of the louvers on the downstream side is degraded. In particular, in the case where the width of the louvers is small, the performance of the heat exchanger will be considerably degraded degrade. Thus, the heat exchanger involves a problem such that it is difficult to enhance the heat transfer efficiency by decreasing the width of the louvers.

A heat exchanger that improves the above-noted problem is disclosed in U.S. Pat. No 2,789,797 which shows a structure wherein louvers are severed and raised in an alternate manner in a direction of air flow to form louver units, and heights of the louvers are changed between the adjacent louvers spaced in the direction of the air flow by a distance corresponding to a length of each louver. However, in the heat exchanger disclosed in U.S. Pat. No. 2,789,797, some adjacent louvers are spaced only by approximately one fourth of the fin pitch, and hence, it would be difficult to separate the temperature boundary layers along such louvers. At the same time, water droplets or dust would be adhere to such louvers, to prevent the air from flowing smoothly and to reduce the heat transfer performance. Also, because of the prevention of the air flow, the flow resistance would be increased. Thus, the prior art heat exchangers suffer from such problems.

OBJECTS AND SUMMARY OF THE INVENTION

An object of the present invention is to provide a heat exchanger having a high heat transfer performance.

Another object of the present invention is to provide a heat exchanger which is capable of eliminating concern that louvers would be clogged or plugged by water droplets adhering to fin surfaces or dust entrained in the air.

The present invention is characterized in that an even number of louvers (more than four) are severed and raised between a remaining first fin base and a remaining second fin base located just downstream of the first fin base, in an alternate and staggered manner symmetrically with a midpoint between the adjacent first and second fin bases. The heights of every two louvers and the second fin base are changed along a line slanted a constant angle $\theta$ with respect to a fin base line.

These and other objects, features and advantages of the present invention will become more apparent by the following descriptions taken in conjunction with the accompanying drawings.

BRIEF DESCRIPTION OF THE DRAWINGS

In the accompanying drawings:

FIGS. 1 to 4 show a heat exchanger in accordance with a presently preferred embodiment of the invention, wherein FIG. 1 is a perspective view showing a primary part of the heat exchanger, FIG. 2 is a perspective view showing the overall appearance of the heat exchanger, FIG. 3 is a cross-sectional view, taken along the line III—III of FIG. 1, showing the primary part of the heat exchanger illustrating flows of fluid therealong, and FIG. 4 is a front elevational view showing a fin structure;

DESCRIPTION OF THE PREFERRED EMBODIMENTS

An embodiment of the present invention will now be described with reference to the accompanying drawings.

Figure 1:
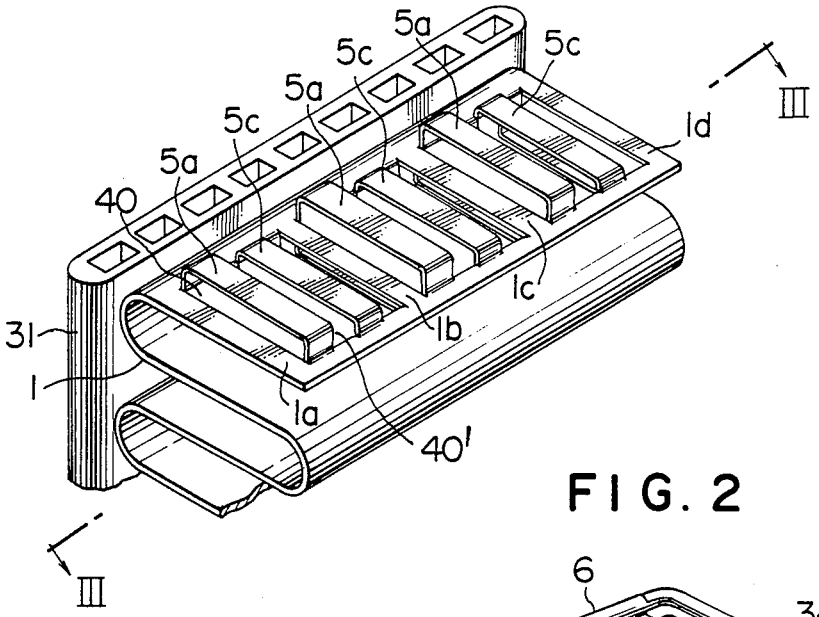
Figure 2:
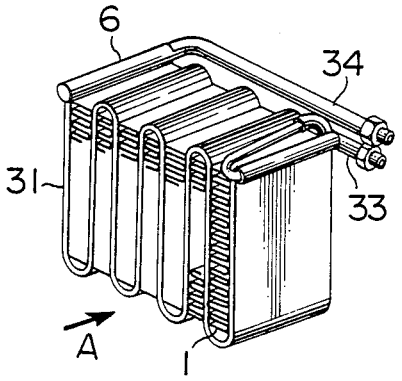

FIG. 1 is a perspective view showing a heat exchanger for an automotive air-conditioner in accordance with one embodiment of the present invention and FIG. 2 is a perspective view showing the overall appearance of the heat exchanger shown in FIG. 1. As shown in FIG. 2, in accordance with the embodiment, corrugated fins 1 each of which is bent in serpentine manner are disposed between adjacent parts of a flat fluid tube 31 which is bent also in a serpentine manner through a cold working. The corrugated fins 1 and the flat fluid tube 31 are brazed or soldered in a high temperature furnace to form a heat exchanger structure. Then, the heat exchanger structure is provided with an inner fluid inlet tube 33 and an inner fluid outlet tube 34. With such a structure, a heat exchange operation is performed between a coolant flowing within the flat fluid tube 31 and an air flowing outside the tube 31 through the corrugated fins 1.

In FIG. 1, reference characters 5*a*, 5*b*, 5*c* and 5*d* denote severed and raised louvers (which will hereinafter be simply referred to as "louvers") formed in the fins 1. Reference characters 1*a*, 1*b* and 1*c* denote fin bases remaining after severing and raising the louvers 5. In the embodiment shown, four louvers are formed between end of the remaining fin bases 1*a*, 1*b* and 1*c*.

Figure 3:
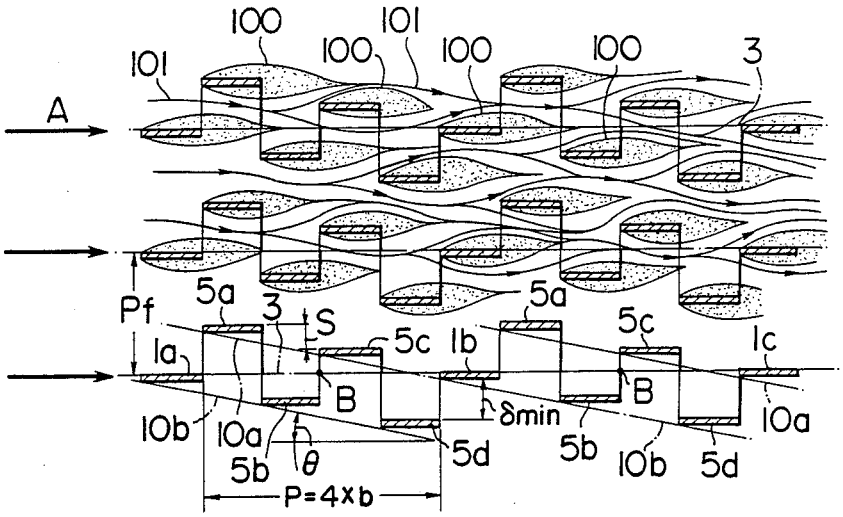

FIG. 3 is a cross-sectional view taken along the line III—III of FIG. 1. In FIG. 3, a line 3 represents a fin base line, and lines 10*a* and 10*b* represent a direction of the louver arrangement. The louvers 5*a*, 5*b*, 5*c*, 5*d*, ... are punched in an alternate or staggered manner in the opposite directions with respect to the fin base line 3. The louvers 5*a*, 5*b*, 5*c* and 5*d* are formed to have different raised heights substantially in a symmetrical relationship with respect to a midpoint between the adjacent pair of the remaining fin bases 1*a* and 1*b*. In other words, the respective louvers and the remaining fin bases on the same side with respect to the fin base line 3 are arranged in a stepped manner along lines 10*a* and 10*b* which slant at a predetermined constant angle $\theta$ with respect to the fin base line 3 that is in parallel with the flow of fluid.

According to the foregoing embodiment, with such an arrangement, a distance from adjacent louvers in the direction of air is kept substantially constant. Also, a dimension of a minimum louver gap $\delta$ min defined between the remaining fin base 1*a* and the louver 5*a* and between the remaining fin base 1*b* and the louver 5*d* may be kept large since that minimum dimension is not restricted by the louver width in the air flow direction.

When the air is caused to flow in the direction indicated by the arrow A and to enter the heat exchanger, the air flow 101 is uniformly branched between the respective louvers, and the air as a whole flows linearly, since the louvers are arranged in the stepped manner along the lines 10*a* and 10*b* as shown in FIG. 3. Therefore, a possible pressure loss may be suppressed. Each thermal boundary layer 100 formed on a louver 5 is cut by every louver, without any adverse effect to downstream louvers. Thus, all the louvers may be used to fullfil their heat transfer function.

As described above, the louvers and the remaining fin bases located on the same side of the fin base line 3 along the lines slanted at the constant angle $\theta$ with respect to the fin base one 3 are arranged in the stepped manner. Therefore, even if the width of the louvers is decreased, the louver gap may be kept sufficiently large, and the air flow may well follow the respective louver substantially uniformly. The thermal boundary layers formed on the louvers will not grow but will be cut. For this reason, the "edge effect" of the respective louver may be exhibited to a maximum possible extent. Therefore, it is possible to decrease the louver width up to approximately 0.5 mm. A heat transfer efficiency of the fin structure according to the present invention is considerably superior to that of a conventional fin structure.

Figure 4:
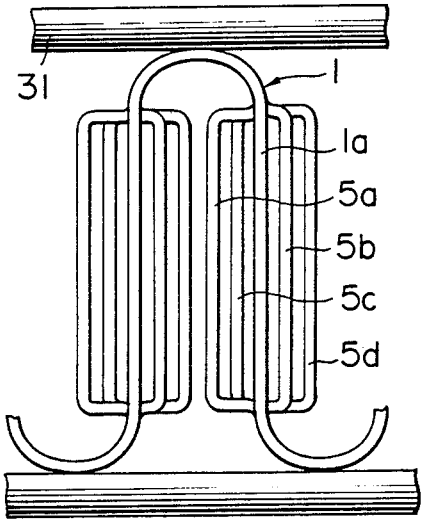

As best shown in FIG. 4, the fin structure is such that the louvers 5*a*, 5*c* (5*b*, 5*d*) embrace the remaining fin base (1*a*, 1*b*, 1*c*, ...) to support the fin 1 on both sides in a symmetrical manner. Therefore, a mechanical resistance against a buckling deformation caused by brazing is increased. This makes it possible to thin the fin base plate much more for practical use and to reduce material cost of the heat exchanger to provide an inexpensive heat exchanger.

In the foregoing embodiment, four louvers are severed and raised between the adjacent remaining fin bases, by way of example. It is apparent that the even number, not smaller than six, of louvers may be formed.

Figure 5:
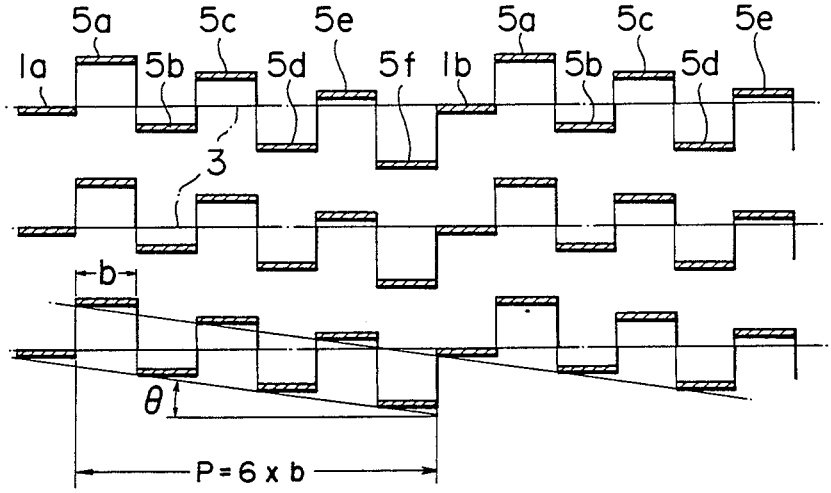
FIGS. 5 to 7 are cross-sectional views of louver portions of fins in accordance with other embodiments of the invention.
Figure 6:
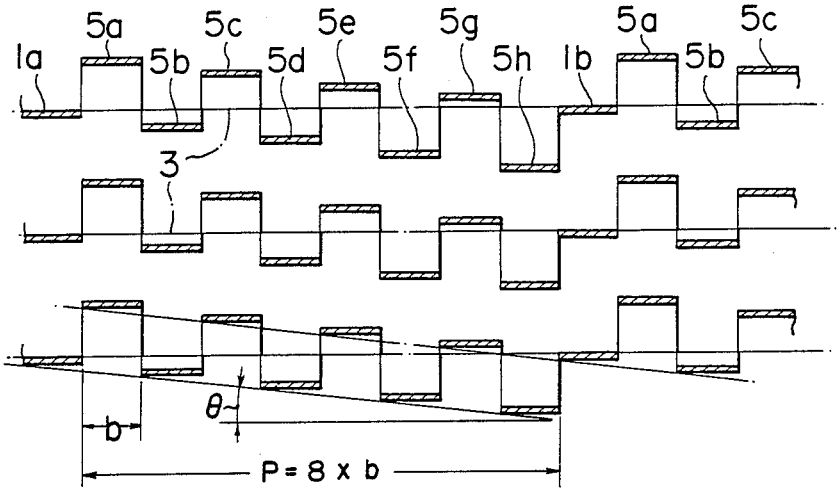

FIGS. 5 and 6 show embodiments in which the even number, not smaller than six, of the louvers are formed between the adjacent remaining fin bases. More specifically, FIG. 5 shows an embodiment in which six louvers are severed and raised between the adjacent remaining fin bases, and FIG. 6 shows an embodiment in which eight louvers are severed and raised between the adjacent remaining fin bases. Also, in these embodiments, the louvers are severed and raised alternately on the opposite sides of the fin base line like bridges, and heights of the louvers on each side are defined along the line inclined or slanted at a constant angle $\theta$ with respect to the fin base line 3 that is in parallel with the flow of the air.

Figure 7:
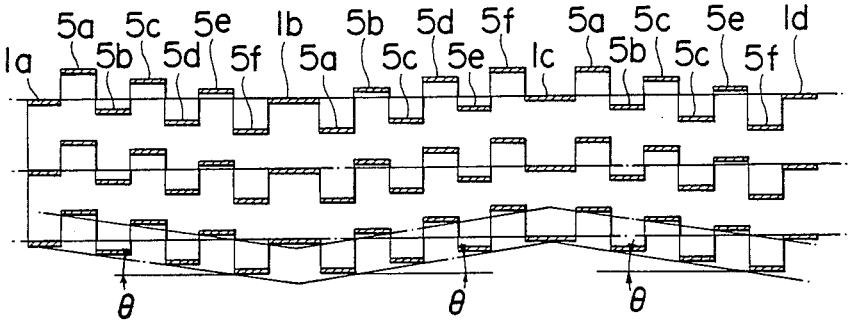

In the foregoing embodiments, the louver arrangement direction expressed by a slant angle $\theta$ defined between a fin base line and the line connecting the most raised louver and the remaining fin base is kept constant. However, according to the present invention the louver arrangement direction slanted by a constant angle $\theta$ with respect to the fin base line may be changed in every louver group between the remaining fin bases or in every plural louver groups. In an embodiment shown in FIG. 7, six louvers are severed and raised between the adjacent remaining fin bases in a staggered manner, with heights of the louvers located on the same side with respect to the fin base line being varied along a line slanted at a constant angle $\theta$. Further, in FIG. 7, the directions of the slant defined by the angle $\theta$ are changed in an alternate manner in every louver group of the alternately severed and raised louvers between the remaining fin bases. In other words, in FIG. 7, a group of louvers 5*a* to 5*f* between the remaining fin bases are arranged downwardly at an angle $\theta$ with respect to the fin base line, whereas an adjacent group of louvers 5*a* to 5*f* are arranged upwardly at an angle $\theta$ with respect to the fin base line, so that the directions defined by the angle $\theta$ are changed in an alternate manner in every louver group.

In the foregoing embodiment, the fin base portion in which the louvers are to be formed is made ductile by a cutting and raising work for the purpose of forming the louvers. After completion of the work, the louvers tend to be restored to the original shape due to springback or resiliency. As a result, compression stresses are exerted to the remaining fin bases 1*a*, 1*b*, 1*c*, . . . to which the work is not applied. The relative positions of the remaining fin bases with respect to the louvers will not be stabilized. In order to prevent this phenomenon, buckled portions are formed in the remaining fin base plate to absorb the compression stresses with the buckled portions. The buckled portions may be formed by bending parts of the remaining fin bases in V-shapes or U-shapes in a direction perpendicular to the flow of the air, for example. Also, instead of the formation of the buckled portions in the remaining fin bases, it is possible to fold back parts of the remaining fin bases in the direction parallel with the air flow, to thereby increase mechanical strength of the remaining fin bases to prevent the generation of stresses on the remaining fin bases.

Comparative results in heat transfer performance between the fins of the heat exchanger in accordance with the embodiments of the invention and the conventional fins in which the louvers are alternately severed and raised without any remaining fin bases will be explained with reference to FIGS. 8 and 9.

The performance comparative experiments were conducted in accordance with a method of measuring heat transfer coefficient by using thermistor heaters. Each of the thermistor heaters that were used in the experiments had a thickness of 1 mm, a louver length b of 10 mm and an entire width of 150 mm. Eleven rows of these thermistor heaters are arranged in the air flow direction, to form a louver group corresponding to an actual fin arrangement having a fin pitch Pf of 2 mm, a louver width of 1.0 mm. The thermistor heater corresponding to the single louver severed and raised from the fin bases plate electrically heated. The heat transfer coefficient was obtained by the following formulae:

$$\alpha = \frac{Q}{\Delta T \cdot A} \quad (1)$$

$$Q = Q_H - Q_l \quad (2)$$

$$\Delta T = Tai - Tw \quad (3)$$

where

Q : the heat quantity (W) transferred to the air, $Q_H$ : the generated heat quantity (W) of the heater, $Q_l$: the heat loss (W), A : the heat transfer are ($m^2$) over which the heater and the air were contacted, ΔT : the temperature difference (° C.) between the surface of the thermistor heater and the air at the inlet, Tw : the surface temperature (° C.) of the thermistor heater, and Tai : the temperature (° C.) of the air at the inlet.

In order to obtain the performance of the actual fin, the well known Reynolds number Re and Nusselt number Nu were used.

$$Re = \frac{v_f \cdot b}{\nu} \quad (4)$$

$$Nu = \frac{a \cdot b}{\lambda} \quad (5)$$

where $v_f$ is the flow velocity (m/s) of the main flow, $\nu$ is the kinematic viscosity coefficient, and λ is the thermal conductivity (W/mK) of the air.

Figure 8:
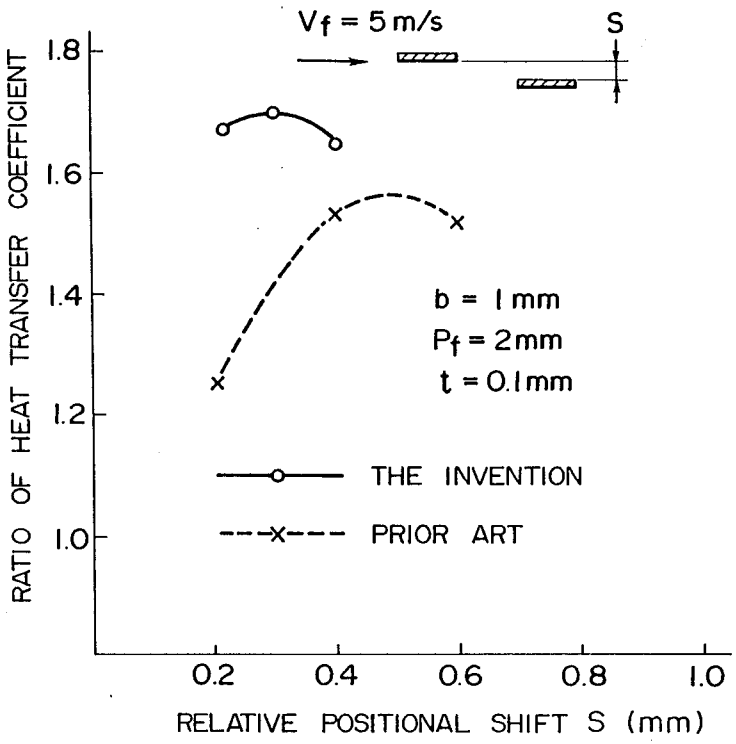

FIG. 8 shows the comparison of the experimental results of the heat transfer coefficients in case of changing a relative positional shift S between the louvers on one which is diposed on the downstream side by a distance corresponding to a width of the single louver. It is appreciated that the fin according to the embodiments is much superior in heat transfer performance to the conventional fin. In particular, it is appreciated that, in the conventional fin, the performance is considerably degraded at the relative positional shift S in the range of 0.4 to 0.2 mm, whereas, in the fin according to the embodiments, the performance is not changed remarkably. FIG. 9 shows this distinction more clearly. In FIG. 9, the same date are used but the heat transfer coefficients are plotted in accordance the minimum louver gaps δmin. It is preferable that, in an automotive air cooler, since moisture in the air is condensed on the fin surfaces to form water droplets, the minimum louver gap be large as much as possible. However, in this conventional fin, the minimum louver gap δmin would be increased, the relative louver positional shift S would be small so that the considerable performance reduction would be noticed as shown in FIGS. 8 and 9. In contrast, in the fin according to the present invention, the heat transfer coefficients are considerably improved in the region (0.7 to 0.8 mm) in which the minimum gap is larger than that of the conventional fin. According to the fin of the invention, the fin clogging due to the water droplets formed on the fin surfaces or dusts may be prevented, to thereby provide a heat exchanger having a high heat transfer performance.

Figure 9:
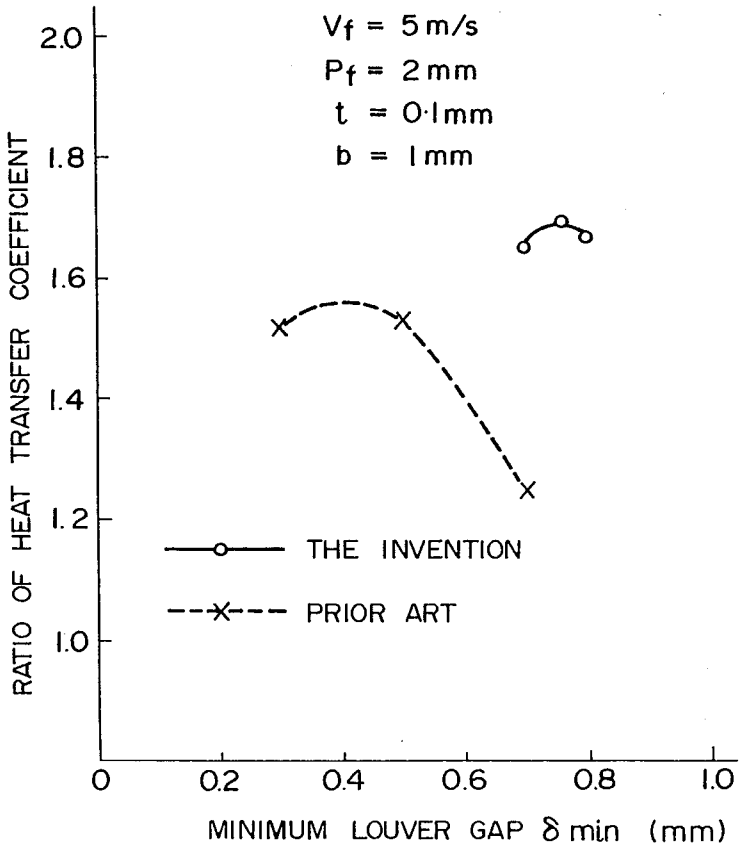
FIGS. 8 and 9 show comparisons in performance between the present invention and the prior art.

Incidentally, the data shown in FIGS. 8 and 9 are concerned with the louver arrangement of the louvers having a fin pitch Pf of 2 mm, a louver width b of 1 mm and a thickness t of 0.1 mm, but these dimensions may of course be changed in accordance with the desired design.

A suitable range of the slant angle of the louver arrangement in accordance with the embodiments of the invention will be explained in view of actual factors such as adhesion of water droplet or the like.

Figure 10:
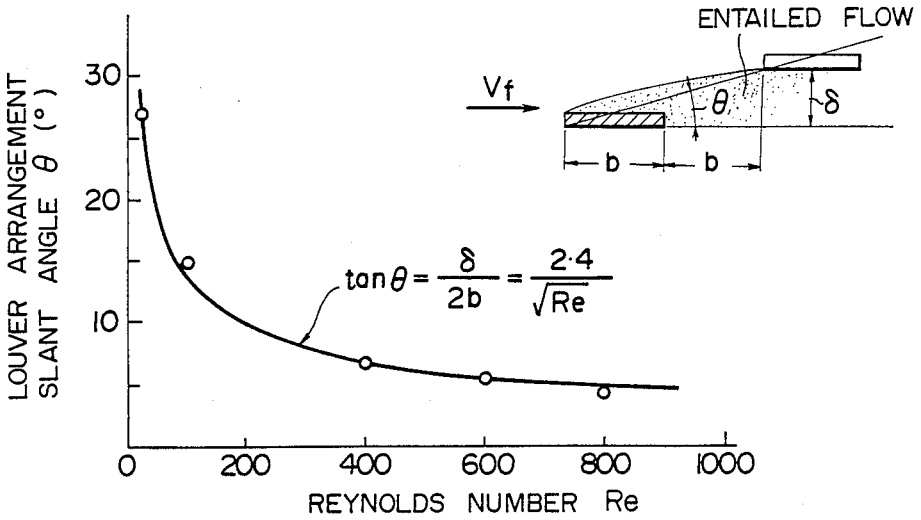
FIG. 10 is a graph showing a relationship between louver arrangement slant angles $\theta$ and Reynolds numbers according to the present invention.

A boundary layer thickness δ of a trailing flow generated downstream of the flat plate disposed in a uniform air flow corresponds to a thermal boundary layer that is generated on the louver and entrained on the downstream side to affect the performance of the downstream louvers. Therefore, it is preferable that the relative positional shift S between the upstream louver and the downstream louver be larger than the thickness δ of the boundary layer. Then, the lower limits of the arrangement slant angle θ may be obtained assuming that a relationship S=δ, as shown in FIG. 10. In FIG. 10, an abscissa of the graph of FIG. 10 represent a Reynolds number given by the formula (4). The parameters availably used in the air-conditioner heat exchanger are specified as follows: b=1 to 2 mm, $v_f$=1 to 5 m/s, and Re=100 to 600. A small angle θ in the range of 5 to 15 degrees may suffice.

Figure 11:
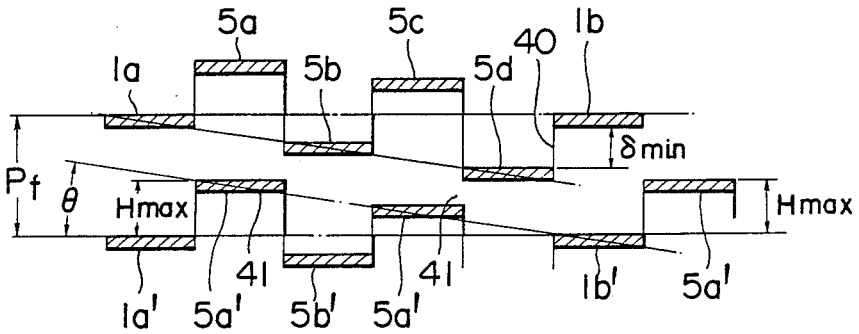
FIG. 11 is a view illustrating a maximum raised height Hmax of a heat exchanger fin structure according to an embodiment of the invention.

For a raised height of the louver severed from the fin base, a maximum raised height Hmax is restricted in view of shaping work with a limit of elongation or ductility of the fin material for the raised louver. Normally, the arrangement pitch (fin pitch) Pf of the fin base plate of the air-conditioner heat exchanger is about 1.5 to 3 mm, and it is preferable to substantially establish the relationship, Hmax ≦Pf/2.However, when the height Hmax is small as shown in FIG. 11, the louver minimum gap δmin is smaller than that given by the following formula:

$$\delta min = Hmax - t \quad (6)$$

where t is a louver thickness (m). In this case the fin structure has a small resistance against the clogging of the louver due to the water formed on the fin surface, dusts or the like.

Figure 12:
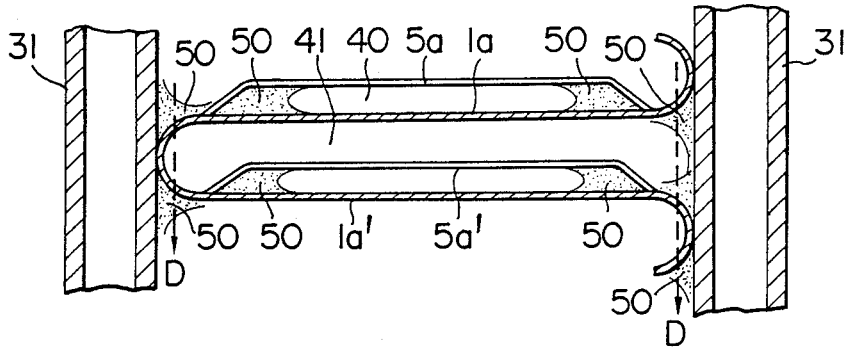
FIGS. 12 and 13 are enlarged views of primary parts of heat exchangers in accordance with the invention, showing water droplet adhering states.
Figure 13:
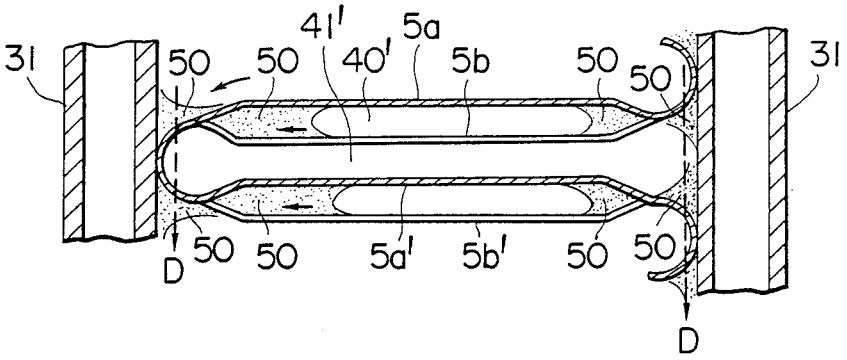

FIGS. 12 and 13 show observation results of the water adhesion states in an evaporator for an automotive air-conditioner. The observations were carried out under the condition that the air temperature was 25° C., the relative humidity was 60% and the front air flow velocity $v_f$=2 m/s, with cold water at a temperature of 5° C. flowing through the tubes.

As a result of the observations, the following phenomena were noted:

(1) The water droplets 50 formed on the fin surfaces were sucked to Y-shaped, severed portions at louver proximal ends in opening portions 40 and 40' formed by cutting and raising the louvers.

(2) The droplets were collected at wedge-shaped spaces formed at connecting portions between fins 1 and the flat tube 31 and flowed down along the connecting portions to be discharged in the direction indicated by the arrows D in FIGS. 12 and 13.

(3) The water drain velocity was restricted so that the water droplets 50 were always remaining at the Y-shaped, severed portions at the louver proximal ends during the operation. In particular, in the case where the minimum louver gap δmin was small, the large amount of water was left thereat.

From the above observation results, it was appreciated that the minimum louver gap δmin had to be enlarged in order to prevent the clogging by the water droplets; that is, the maximum louver raised height Hmax in FIG. 11 had to be increased.

In the case where the maximum raised height Hmax is given in view of the work limits as follows:

$$\text{Hmax} = \tfrac{1}{2}\text{Pf} \tag{8}$$

as apparent from FIG. 11, the louver 5*d* and the louver 5′ are aligned with each other on the same line, so that the entailed flow of the upstream louver affects the downstream louver to thereby reduce the heat transfer efficiency. Accordingly, based upon the foregoing discussions, it is preferable that the maximum raised height Hmax be defined by the following formulae (9) and (10) in view of the condition that the relative positional shift S of the louvers separated by the distance corresponding to the width of the single louver be greater than the thickness δ of the boundary layer as illustrated in FIG. 10.

$$H\text{max} \leqq \frac{Pf}{2} - b \times \tan\theta \tag{9}$$

$$\tan\theta = \frac{2.4}{\sqrt{Re}} \tag{10}$$

Figure 14:
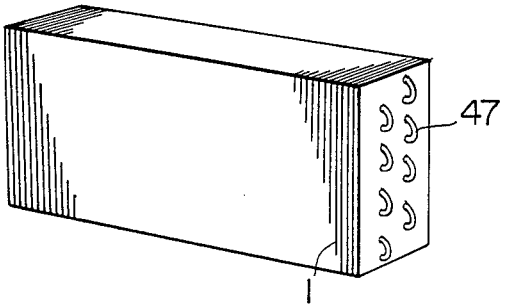
FIG. 14 is a perspective view showing a heat exchanger in accordance with still another embodiment of the invention.
Figure 15:
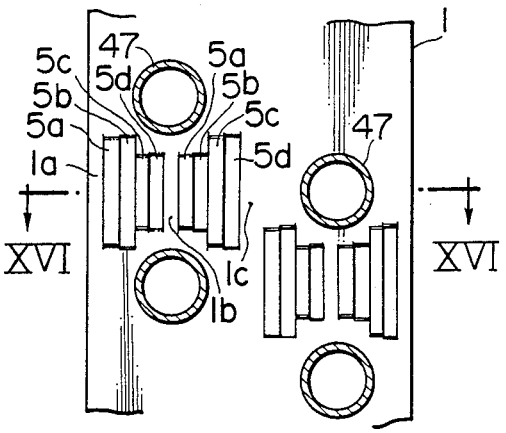
FIG. 15 is a cross-sectional view of a part of the heat exchanger shown in FIG. 14.
Figure 16:
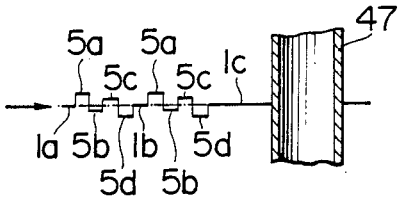
FIG. 16 is a cross-sectional view taken along the line XVI—XVI of FIG. 15.

Still another embodiment of the present invention will now be explained with reference to FIGS. 14 to 16. FIG. 14 is a perspective view of a cross fin tube type heat exchanger constructed so that a plurality of circular tubes 47 are adapted to pass through fins 1. FIG. 15 is a partial cross-sectional view taken along a line that is in parallel with the fins 1 in FIG. 14. FIG. 16 is a cross-sectional view of a louver group taken along the line XVI—XVI. Also, in such a heat exchanger construction, the louver cross-section is the same as illustrated before. Therefore, the same effects and advantages are insured in the heat exchanger shown in FIGS. 14 to 16. In other words, the structure shown in FIGS. 14 to 16 has a high resistance against the clogging due to the water droplets formed on the fin surfaces or the dusts entrained in the air flow, thus providing a cross-fin tube type heat exchanger having a high heat transfer performance.

As described above, according to the present invention, four or more louvers having an even number are severed and raised, in series, in a staggered manner with respect to the fin base line, and every two louvers (including fin bases) are arranged in a stepped manner in a direction slanted at a constant angle θ with respect to the fin base line. Accordingly, a minimum louver gap may be large. The heat exchanger according to the present invention has a high clog-proof property against the water droplets, dusts or any other foreign matter with a high heat transfer performance. Also, the louvers are symmetrical with respect to the fin base plate, so that the buckling resistance strength is increased during the brazing or soldering works, which leads to a high productivity.

What is claimed:

1. A heat exchanger having, in combination, a number of fins and at least one heat transfer tube held in contact with said fins, said fins being severed to form slits therein and alternately raised to form bridge-like louvers in a staggered manner with respect to a fin base line, said heat exchanger characterized in that the number of said louvers grouped in a louver group defined between a first fin base and a second fin base, adjacent to said first fin base, arranged along said fin base line is an even number not smaller than four; a louver, closest to said first fin base, of said louver group has a maximum raised height; and the other louvers, of said louver group, located on the same side with respect to said fin base are arranged along a line connecting said louver having said maximum raised height and said second adjacent fin base to each other.

2. A heat exchanger according to claim 1, wherein an angle defined between said fin base line and said line connecting said louver having said maximum raised height and said second fin base is in a range of 5 to 15 degrees.

3. A heat exchanger according to claim 2, wherein said maximum raised height Hmax of the louver satisfies the following formulae:

$$H\text{max} \leqq \frac{Pf}{2} - b\tan\theta, \text{ and}$$

$$\tan\theta = \frac{2.4}{\sqrt{Re}}$$

where θ is said angle, Pf is the fin pitch and b is the width of the louver and Re is the Reynolds number.

4. A heat exchanger according to claim 1, wherein said angle θ defined between said fin base line and a line connecting said louver having said maximum raised height and said second fin base is alternately changed in every one or more louver groups.

5. A heat exchanger wherein an even number, not smaller than four, of louvers are severed and raised, alternately with respect to a fin base line, in bridge-like shapes between a first fin base and a second fin base and the louvers located on the same side with respect to said fin base line are arranged along a line having a constant angle θ (>0°) with respect to said fin base line and connecting with one of said fin bases.

* * * * *